US005295435A

United States Patent [19]

Fuchi

[11] Patent Number: 5,295,435

[45] Date of Patent: Mar. 22, 1994

[54] PLATE LOCKUP APPARATUS FOR PRINTING PRESS

[75] Inventor: Yutake Fuchi, Ibaraki, Japan

[73] Assignee: Komori Corporation, Japan

[21] Appl. No.: 974,061

[22] Filed: Nov. 10, 1992

[30] Foreign Application Priority Data

Nov. 13, 1991 [JP] Japan ..... 3-101070[U]

[51] Int. Cl.[5] ..... B41F 1/28

[52] U.S. Cl. ..... 101/415.1; 101/378

[58] Field of Search ..... 101/378, 409, 415.1

[56] References Cited

U.S. PATENT DOCUMENTS

| | | | |
|---|---|---|---|
| 3,460,443 | 8/1969 | Sarka et al. | 101/415.1 |
| 5,088,410 | 2/1992 | Murakami | 101/415.1 |
| 5,168,810 | 12/1992 | Kojima | 101/415.1 |
| 5,181,469 | 1/1993 | Merkel et al. | 101/415.1 |
| 5,182,994 | 2/1993 | Sugiyama | 101/415.1 |
| 5,199,352 | 4/1993 | Sugiyama | 101/415.1 |

FOREIGN PATENT DOCUMENTS 3-65343 3/1991 Japan .

*Primary Examiner*—Edgar S. Burr
*Assistant Examiner*—Stephen R. Funk
*Attorney, Agent, or Firm*—Blakely, Sokoloff, Taylor & Zafman

[57] ABSTRACT

A plate lockup apparatus for a printing press includes a lockup table, a gripper plate, a cam shaft, a pin, and a compression coil spring. The lockup table is supported on a bottom surface of a gap in a circumferential surface of a cylinder to be movable forward/backward perpendicularly to the axis of the cylinder, and extends in the axial direction of the cylinder. The gripper plate is swingably and pivotally supported on the lockup table such that its gripper surface opposes the lockup table, and is constituted by a horizontal member extending in a circumferential direction of the cylinder and a vertical member extending in a radial direction of the cylinder to have a substantially L-shaped section. The cam shaft is disposed between the lockup table and the wall surface of the gap to be rotatable in the axial direction of the cylinder. The pin is moved forward/backward in accordance with rotation of the cam shaft to close the gripper surface by acting on the vertical member of the gripper plate when the pin moves forward/backward within a predetermined amount, and to move the lockup table in a direction opposite to the cam shaft by acting on the lockup table when the pin moves forward-/backward exceeding a predetermined amount. The compression coil spring biases the lockup table toward the cam shaft.

4 Claims, 2 Drawing Sheets

PLATE LOCKUP APPARATUS FOR PRINTING PRESS

BACKGROUND OF THE INVENTION

The present invention relates to a plate lockup apparatus provided in a plate cylinder of a printing press for fixing leading and trailing sides of a plate to be wound on a circumferential surface of the plate cylinder.

Generally, a gap having a substantially rectangular section is formed in the circumferential surface of the plate cylinder of each of various types of printing presses to extend for almost an entire length of the cylinder. A plate lockup apparatus consisting of a leading-side plate lockup device for gripping the leading end of a plate and a trailing-side plate lockup device for gripping the trailing end of the plate gripped by the leading-side plate lockup device and wound on the circumferential surface of the cylinder extends in the gap in the axial direction of the cylinder by being supported on the bottom surface of the gap.

Conventionally, of the plate lockup apparatuses of this type, a spring closed plate lockup apparatus has a structure as disclosed in, e.g., Japanese Patent Laid-Open No. 3-65343 proposed by the present applicant. More specifically, each of the leading- and trailing-side plate lockup devices of this plate lockup apparatus has an elongated lockup table extending in the axial direction of the cylinder, and gripper plates pivotally supported by the lockup table and opened and closed by rotation of the lockup table to grip and release the plate with cooperation with the lockup table. Leading- and trailing-side cam shafts each having a plurality of cams to engage with the corresponding gripper plates extend in the vicinity of the gripper plates in the axial direction of the cylinder. In the spring closed plate lockup apparatus having the above structure, compression coil springs are interposed between the gripper plates and each lockup table to bias the gripper plates in a closing direction toward the corresponding lockup table.

In the conventional plate lockup apparatus having the above structure, when the plate is to be gripped, the leading-side cam shaft is pivoted manually or by a driving unit to open the gripper plates by the function of the cams against the elastic force of the compression coil springs, and one end of the plate is inserted between the gripper surfaces of the gripper plates and the lockup table. Then, the cam shaft is pivoted in the reverse direction, so that the gripper plates are released from the function of the cams and are closed by the elastic force of the compression coil springs, thus gripping one end of the plate. When the plate cylinder is rotated by almost one revolution, the plate is wound on the circumferential surface of the cylinder. The trailing end of the plate is gripped by the trailing-side plate lockup device in the same manner as in the leading end of the plate. When the trailing-side cam shaft is further pivoted, the trailing-side plate lockup device is moved in the circumferential direction of the plate, thus tightening the plate to be brought into tight contact with the circumferential surface of the cylinder.

However, in such a conventional plate lockup apparatus, since the plate gripping operation by the plate lockup devices and the plate tightening operation are performed by the spring force, the plate cannot sometimes be sufficiently gripped or mounted depending on its thickness or material. In addition, the structure of the apparatus is complicated. Also, the trailing end of the plate must be bent almost at 90° to the circumferential surface of the plate so that the plate is gripped by the trailing-side plate lockup device. For this purpose, a special plate bending machine must be used.

SUMMARY OF THE INVENTION

It is an object of the present invention to provide a plate lockup apparatus for a printing press, which can obtain a sufficiently large plate gripping force regardless of the thickness or material of the plate.

It is another object of the present invention to provide a plate lockup apparatus for a printing press, which has a simple structure and which does not need a special plate bending machine.

In order to achieve the above objects, according to the present invention, there is provided a plate lockup apparatus for a printing press, comprising a lockup table supported on a bottom surface of a gap in a circumferential surface of a cylinder to be movable forward and backward in a direction perpendicular to an axial direction of the cylinder and extending on the axial direction of the cylinder, a gripper plate swingably and pivotally supported on the lockup table such that a gripper surface thereof opposes the lockup table and constituted by a horizontal member extending in a circumferential direction of the cylinder and a vertical member extending in a radial direction of the cylinder to have a substantially L-shaped section, a cam shaft disposed between the lockup table and a wall surface of the gap to extend in the axial direction of the cylinder to be rotatable, a transmission member, moved forward and backward in accordance with rotation of the cam shaft, for closing the gripper surface by acting on the vertical member of the gripper plate upon a forward/backward movement of the transmission member within a predetermined amount, and for moving the lockup table in a direction opposite to the cam shaft by acting on the lockup table upon a forward/backward movement of the transmission member exceeding a predetermined amount, and a spring member for biasing the lockup table toward the cam shaft.

DESCRIPTION OF THE PREFERRED EMBODIMENT

Figure 1:
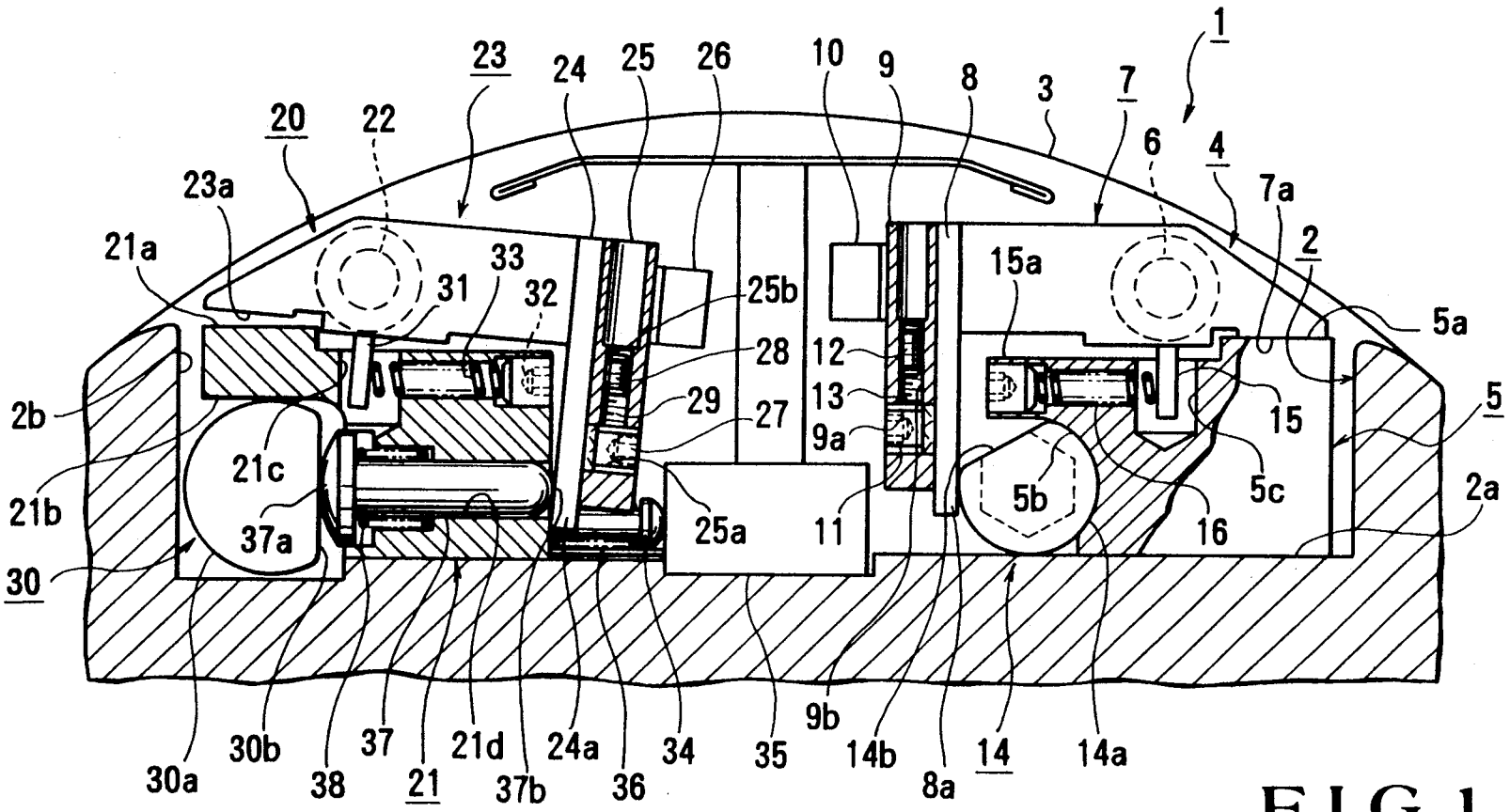
FIG. 1 is a longitudinal sectional view of a plate lockup apparatus for a printing press according to an embodiment of the present invention.
Figure 2:
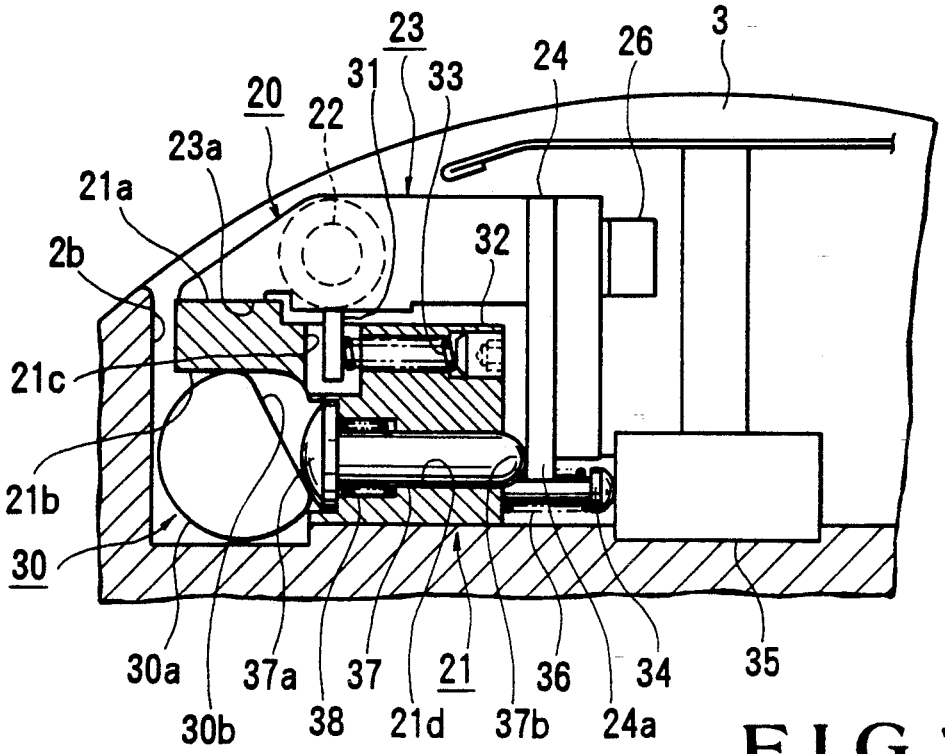
FIG. 2 is a longitudinal sectional view of a trailing-side plate lockup device before a plate is mounted by the plate lockup apparatus shown in FIG. 1.
Figure 3:
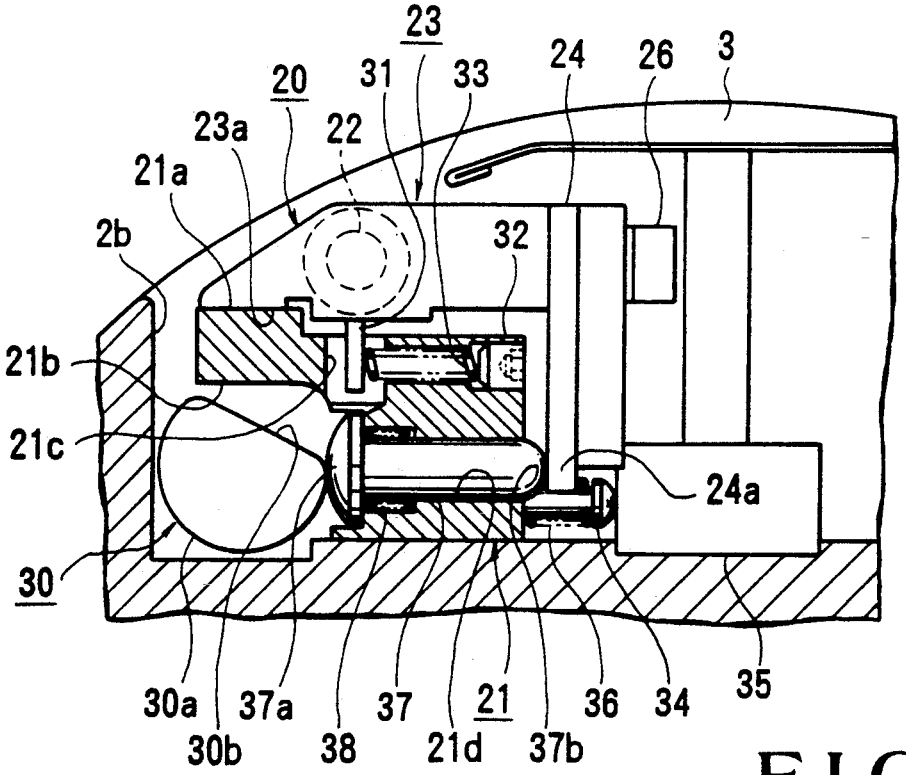
FIG. 3 is a longitudinal sectional view of the trailing-side plate lockup device after the plate is mounted by the plate lockup apparatus shown in FIG. 1.

FIGS. 1 to 3 show a plate lockup apparatus for a printing press according to an embodiment of the present invention, in which FIG. 1 shows the plate lockup apparatus, FIG. 2 shows a trailing-side plate lockup device before a plate is mounted, and FIG. 3 shows a leading-side plate lockup device after the plate is mounted. Referring to FIGS. 1 to 3, a gap 2 having a substantially rectangular section is formed in the outer circumferential portion of a plate cylinder 1 to extend for almost the entire length of the cylinder 1, and the two open ends of the gap 2 are closed by disk-like bearers 3. A leading-side plate lockup device 4 has a lockup table 5 having a substantially rectangular section and extending in the axial direction of the cylinder 1. The lockup table 5 is fixed on a bottom surface 2a of the gap 2 by being urged by a plurality of blocks (not shown). The lockup table 5 can be moved by an adjustment unit (not shown) in the circumferential direction of the plate cylinder 1 along the bottom surface 2a of the gap 2.

Gripper plate holders (not shown) are fixed at a plurality of locations of the lockup table 5. A plurality of gripper plates 7 divided in the axial direction of the plate cylinder 1 and having almost the same entire length as that of the lockup table 5 and a substantially rectangular section are swingably supported by pins 6 projecting from the gripper plate holders in the axial direction of the cylinder 1. Plate gripper surfaces 7a of the gripper plates 7 oppose a gripper surface 5a of the lockup table 5. A cam reception plate 8 having almost the same length as that of the gripper plates 7 as a whole and a plurality of support plates 9 are stacked on the counter gripper-side end faces of the gripper plates 7 to have an L-shaped section together with the gripper plates 7, and are fixed by bolts 10. Adjustment screws 11 are screwed in screw holes 9a formed in the lower end portions of the respective support plates 9 to be capable of moving forward/backward such that their distal ends oppose one flat surface of the cam reception plate 8. Set screws 12 are screwed in screw holes 9b in the support plates 9. When synthetic resin pieces 13 are urged against the adjustment screws 11, the set screws 12 can fix the adjustment screws 11 without damaging them.

A cam shaft 14 having a plurality of cam surfaces each consisting of arcuated and linear portions 14a and 14b and a hexagonal section extends between a distal end portion 8a of the cam reception plate 8 and the lockup table 5 such that its two ends are pivotally and axially supported by the bearers 3 at the two ends of the cam shaft 14. The intermediate portion of the cam shaft 14 is supported by an arcuated portion 5b of the lockup table 5. The cam surfaces of the cam shaft 14 oppose the other flat surface of the distal end portion 8a of the cam reception plate 8. Pins 15 provided on the gripper plates 7 are engaged in a plurality of corresponding pin holes 5c formed in the upper surface of the lockup table 5, and compression coil springs 16 for biasing the gripper plates 7 in the opening direction are interposed between the pins 15 and screws 15a screwed in the lockup table 5. The two end portions of the cam shaft 14 project outwardly from the holes in the bearers 3. When the cam shaft 14 is pivoted by a driving unit or by a manual operation, the gripper plates 7 are caused to swing by the functions of the arcuated portions 14a of the cam surfaces and the compression coil springs 16 through the cam reception plate 8, and the plate gripper surfaces 7a are opened or closed with respect to the gripper surface 5a. The lockup table 5 is biased toward the wall surface of the gap 2 by a compression coil spring (not shown).

A trailing-side plate lockup device 20 will be described. The trailing-side plate lockup device 20 has a lockup table 21 having a substantially rectangular section and extending in the axial direction of the cylinder 1. The lockup table 21 is fixed on the bottom surface 2a of the gap 2 by being urged by a plurality of blocks (not shown). The lockup table 21 can be moved by an adjustment unit (not shown) in the circumferential direction of the plate cylinder 1 along the bottom surface 2a of the gap 2.

Gripper plate holders (not shown) are fixed at a plurality of locations of the lockup table 21. A plurality of gripper plates 23 divided in the axial direction of the plate cylinder 1 and having almost the same entire length as that of the lockup table 21 and a substantially rectangular section are swingably supported by pins 22 projecting from the gripper plate holders in the axial direction of the cylinder 1. Plate gripper surfaces 23a of the gripper plates 23 oppose a gripper surface 21a of the lockup table 21. A cam reception plate 24 having almost the same length as that of the gripper plates 23 as a whole and a plurality of support plates 25 are stacked on the counter gripper-side end faces of the gripper plates 23 to have an L-shaped section together with the gripper plates 23, and are fixed by bolts 26. Adjustment screws 27 are screwed in screw holes 25a formed in the lower end portions of the respective support plates 25 to be capable of moving forward/backward such that their distal ends oppose one flat surface of the cam reception plate 24. Set screws 28 are screwed in screw holes 25b in the support plates 25. When synthetic resin pieces 29 are urged against the adjustment screws 27, the set screws 28 can fix the adjustment screws 27 without damaging them.

A cam shaft 30 having a plurality of cam surfaces each consisting of arcuated and linear portions 30a and 30b extends between a wall surface 2b of the gap 2 and an L-shaped portion 21b of the lockup table 21 such that its two ends are pivotally and axially supported by the bearers 3 at the two ends of the cam shaft 30. The intermediate portion of the cam shaft 30 is supported by a bearing (not shown). Pins 31 provided on the gripper plates 23 are engaged in a plurality of corresponding pin holes 21c formed in the upper surface of the lockup table 21, and compression coil springs 33 for biasing the gripper plates 23 in the opening direction are interposed between the pins 31 and the screws 32 screwed in the lockup table 21. The two end portions of the cam shaft 30 project outwardly from the holes in the bearers 3. When the cam shaft 30 is pivoted by a driving unit or by a manual operation, the gripper plates 23 are caused to swing by the functions of the arcuated portions 30a of the cam surfaces and the compression coil springs 33 through the cam reception plate 24, and the plate gripper surfaces 21a and 23a are opened or closed.

Headed pins 34 are inserted in corresponding pin holes (not shown) formed in the lower portion of the lockup table 21 to be slidable in the circumferential direction of the plate cylinder 1. Compression coil springs 36 are interposed between the head portions of the headed pins 34 and the end face of the lockup table 21. The compression coil springs 36 bring the head portions of the headed pins 34 into tight contact with a block 35 fixed at the central portion of the bottom surface 2a of the gap 2, and the lockup table 21 is biased toward the wall surface 2b of the gap 2 by the reaction of the tight contact. Pin holes 21d are formed in the lower portion of the lockup table 21 to extend in the circumferential direction of the plate cylinder 1. Pins 37 are fitted in the respective pin holes 21d to be movable forward/backward. The arcuated sliding surfaces of flanged head portions 37a of the pins 37 contact the cam surfaces of the cam shaft 30, and distal ends 37b of the pins 37 contact the other flat surface of distal end portion 24a of the cam reception plate 24 serving as the vertical member of the gripper plates 23. A compression coil spring 38 is interposed between the head portion 37a of each pin 37 and the step of the corresponding pin hole 21*d*. The pins 37 are biased toward the cam shaft 30 by the elastic force of the compression coil springs 38.

The operation of the plate lockup apparatus having the structure as described above will be described. To mount the plate on the plate cylinder 1, the leading-side plate lockup device 4 is set to oppose the work surface of the operator, and the leading-side cam shaft 14 is pivoted by using a wrench or the like to set the linear portions 14*b* of the cam surfaces to oppose the cam reception plate 8. Then, the gripper plates 7 are pivoted together with the cam reception plate 8 by the elastic force of the compression coil springs 16 to open the gripper surfaces 5*a* and 7*a*. One end of the plate is inserted between the open gripper surfaces 5*a* and 7*b*, and the leading-side cam shaft 14 is pivoted to set the arcuated portions 14*a* of the cam surfaces to oppose the cam reception plate 8. Then, the gripper plates 7 are pivoted through the cam reception plate 8 to close the gripper surfaces 5*a* and 7*b*, thus gripping one end of the plate.

After one end of the plate is gripped in this manner, the plate cylinder 1 is rotated by almost one revolution. Then, the plate is wound on the circumferential surface of the plate cylinder 1, and the trailing-side plate lockup device 20 opposes the work surface of the operator. When the trailing-side cam shaft 30 is pivoted by using the wrench or the like, the arcuated portions 30*a* of the cam surfaces start to contact the head portions 37*a* of the pins 37. In the initial period of rotation of the cam shaft 30, the pins 37 are moved toward the cam reception plate 24 against the elastic force of the compression coil springs 36 and 38 to urge the cam reception plate 24. Since the cam reception plate 24 is pivoted, the gripper plates 23 integral with the cam reception plate 24 are pivoted about the pins 22 against the elastic force of the compression coil springs 33 to grip the trailing end of the plate. After the plate is gripped in this manner, when the cam shaft 30 is further pivoted, the pins 37 are further moved toward the cam reception plate 24, and the head portions 37*a* of the pins 37 abut against the steps of the corresponding pin holes 21*d* of the lockup table 21, as shown in FIG. 2. Thereafter, hence, in the final period of rotation of the cam shaft 30, the biasing force of the arcuated portions 30*a* of the cam surfaces against the pins 37 is transmitted to the lockup table 21 through the head portions 37*a* of the pins 37 and the steps of the corresponding pin holes 21*d*. The lockup table 21 is moved toward the central portion of the gap 2, i.e., is moved in the plate-tightening direction against the elastic force of the compression coil springs 36. The plate is tightened to be brought into tight contact with the circumferential surface of the plate cylinder 1.

In order to remove the plate from this state, the trailing end of the plate gripped by the trailing-side plate lockup device 20 is released, the plate cylinder 1 is rotated, and the leading end of the plate gripped by the leading-side plate lockup device 4 is released in accordance with the mounted state of the plate, so that the plate can be removed. The adjustment screws 27 are moved forward or backward to adjust the plate gripping force.

That is, according to this embodiment, to mount the plate on the plate cylinder, the leading end of the plate is gripped by the leading-side plate lockup device, and the plate cylinder is rotated by almost one revolution to wind the plate on the circumferential surface of the cylinder. Thus, the trailing end of the plate is inserted between the lockup table of the trailing-side plate lockup device and the gripper plates that are open. When the cam shaft of the trailing-side plate lockup device is pivoted, in the initial period of rotation of the cam shaft, the trailing end of the plate is gripped by the function of the cam and the spring force of the spring member, and in the final period of rotation of the cam shaft, the plate is tightened to be brought into tight contact with the circumferential surface of the cylinder.

In this embodiment, the trailing-side plate lockup device has been described. However, this embodiment can naturally be applied to the leading-side plate lockup device. In this case, the plate tightening operation is performed by the leading-side plate lockup device.

As is apparent from the above description, according to the present invention, when the plate is mounted on the plate cylinder, the plate gripping operation and the plate tightening operation can be continuously performed only by pivoting the cam shaft, the plate gripping force and the plate tightening force caused by the cams directly act on the gripper plates and the lock tables, and the plate gripping force can be adjusted. Therefore, the plate gripping force and the plate tightening force can sufficiently be adjusted even if the thickness or material of the plate is changed. The structure is simple, the plate can be easily mounted, and the trailing end of the plate need not be bent so as to be gripped by the trailing-side plate lockup device, eliminating the necessity for a special plate bending machine. Therefore, the plate mounting process is simplified.

What is claimed is:

1. A plate lockup apparatus for a printing press, comprising:

a lockup table supported on a bottom surface of a gap in a circumferential surface of a cylinder, the lockup table being movable forward and backward in a direction perpendicular to an axial direction of said cylinder, the lockup table extending in the axial direction of said cylinder;

a gripper plate swingably and pivotally supported on said lockup table such that a gripper surface thereof opposes said lockup table, said gripper plate having a substantially L-shaped section constituted by a horizontal member extending in a circumferential direction of said cylinder and a vertical member extending in a radial direction of said cylinder;

a cam shaft, disposed between said lockup table and a side wall surface of the gap corresponding to said lockup table, the cam shaft extending in the axial direction of said cylinder, the cam shaft being rotatable for closing the gripper surface of said gripper plate;

a transmission pin, supported in a pin hole with a step portion formed in said lockup table, the transmission pin having a head portion contacting a cam surface of said cam shaft and a distal end portion contacting said vertical member of said gripper plate, the transmission pin moving forward and backward in accordance with rotation of said cam shaft;

a first spring member for biasing said transmission pin toward said cam shaft; and a second spring member for biasing said lockup table toward said cam shaft, wherein:

a first partial rotation of the cam shaft causes the transmission pin to move forward in said pin hole, the distal end portion of the transmission pin acting on the vertical member of the gripper plate causing the gripper surface of the gripper plate to close, the first partial rotation of the cam shaft lasting from a time when the gripper surface of the gripper plate is at least partially open until the transmission pin is moved forward by a predetermined distance and the head portion of the transmission pin abuts the step portion of the pin hole;

a second partial rotation of the cam shaft causes the transmission pin to initially move the lockup plate forward and subsequently to allow the lockup plate to be moved backward, the lockup table being biased by the second spring member, the second partial rotation of the cam shaft lasting from the time of the end of the first partial rotation and as long as the head portion of the transmission pin abuts the step portion of the pin hole; and a third partial rotation of the cam shaft allows the transmission pin to move backward in said pin hole, the transmission pin being biased by the first spring member, the distal end portion of the transmission pin allowing the gripper plate to open at least partially.

2. An apparatus according to claim 1, wherein said head portion of said pin contacting said cam surface has a flange portion with an arcuated sliding surface, and said flange portion abuts said step portion of the pin hole.

3. An apparatus according to claim 1, wherein said predetermined distance is at least the distance traversed by the transmission pin during said first partial rotation of the cam shaft.

4. An apparatus according to claim 1, further comprising a fixing member provided at a central portion of the gap, and wherein said second spring member is interposed between said lockup table and the fixing member.

* * * * *